United States Patent [19]

Fujimaki

[11] Patent Number: 4,747,557

[45] Date of Patent: May 31, 1988

[54] APPARATUS FOR INSERTING AND FEEDING FLATTENED METAL WIRE INTO AND FROM CONTAINERS

[75] Inventor: Koji Fujimaki, Toyonaka, Japan

[73] Assignee: Daiwa Can Co., Ltd., Tokyo, Japan

[21] Appl. No.: 857,488

[22] Filed: Apr. 30, 1986

[51] Int. Cl.[4] ..... B21C 47/10; B21C 47/18

[52] U.S. Cl. ..... 242/83; 242/82

[58] Field of Search ..... 242/82, 83; 140/149

[56] References Cited

U.S. PATENT DOCUMENTS

| | | | |
|---|---|---|---|
| 3,295,785 | 1/1967 | Felicite | 242/83 |
| 3,703,261 | 11/1972 | Cofer et al. | 242/82 |
| 4,075,880 | 2/1978 | Copeland | 140/149 X |
| 4,172,375 | 10/1979 | Rushforth et al. | 242/82 X |
| 4,491,284 | 1/1985 | Vazquez et al. | 242/83 |

FOREIGN PATENT DOCUMENTS 39191 11/1979 Japan .

*Primary Examiner*—John Petrakes

*Attorney, Agent, or Firm*—Wenderoth, Lind & Ponack

[57] ABSTRACT

An apparatus for inserting a flattened metal wire, the flat surfaces of which are set vertical, into a cylindrical container while forming the flattened wire into continuous spiral loops, in such a manner that these loops are stacked in this cylindrical container without being twisted with the loop-forming positions therein staggered sequentially, and an apparatus for feeding the flattened metal wire without twisting the loops from the interior of the cylindrical container to the exterior thereof continuously, and more particularly to an apparatus for inserting into and an apparatus for feeding therefrom a flattened copper wire used for electric welding.

2 Claims, 6 Drawing Sheets

APPARATUS FOR INSERTING AND FEEDING FLATTENED METAL WIRE INTO AND FROM CONTAINERS

BACKGROUND OF THE INVENTION

1. Field of the Invention:

This invention relates to an apparatus for inserting a flattened metal wire, the flat surfaces of which are set vertical, into a cylindrical container while forming the flattened wire into continuous spiral loops, in such a manner that these loops are stacked in this cylindrical container without being twisted with the loop-forming positions therein staggered sequentially. The invention also relates to an apparatus for feeding the flattened metal wire without twisting the loops from the interior of the cylindrical container to the exterior thereof continuously, and more particularly to an apparatus for inserting into, and an apparatus for feeding therefrom a flattened copper wire used for electric welding.

2. Description of the Prior Art:

There is a known apparatus for taking up and rewinding a steel wire of high strength, in which a steel wire is taken up as a reel is rotated, the steel wire thus taken up being rewound as the reel is rotated in the reverse direction.

Japanese Patent Publication No. 39191/1979 discloses a method of taking up in a coiled state a steel wire of high strength in a cylindrical container or around a reel, and then withdrawing the coiled wire while rewinding the same. In this method, a steel wire is taken up as it is twisted 360° per loop without rotating the cylindrical container or reel, and then rewound as it is twisted 360° per loop in the reverse direction.

However, the wire taken up and rewound in this method is a wire having a circular cross section, and it is very difficult to employ this method for taking up and rewinding a flattened metal wire. When a flattened metal wire is taken up as a reel is rotated, the diameter of the wound part of the metal wire increases as the winding thereof progresses, and, therefore, the radii of curvature of different parts of the wound metal wire are unequal. Hence, it is very difficult to take up and rewind such a metal wire without twisting the same.

Moreover, as the winding of the flattened metal wire progresses, the length of each loop differs. Therefore, in order to take up and rewind the flattened metal wire at a constant rate, it is necessary to regulate the rotational speed of the reel in accordance with the variations of the diameter of the wound metal wire. In order to use this flattened metal wire as a welding electrode wire, it is necessary to control the winding rate and feed rate while maintaining a constant posture of the wire, in accordance with the welding rate.

An experiment was made to take up a flattened metal wire while twisting the same at 360° per loop, without rotating a cylindrical container or a reel, as in the method disclosed in Japanese, Patent Publication No. 39191/1979. The result was that the metal wire could not constantly be taken up. Namely, as the flattened metal wire has a nearly-rectangular cross section and different longitudinal and lateral section moduli, it did not form loops of a constant radius, unlike a metal wire of a circular cross section, during the twisting of the metal wire being taken up. In concrete terms, the flattened metal wire thus taken up became elliptic and failed to have a horizontal predetermined shape.

An electrode wire used in a conventional electric resistance welding apparatus (FIG. 1) for cans consists of a copper wire 20 of a circular cross section. Before this copper wire has been fed onto a welding roll 11, it is compressed to a flat shape to be used as a flattened copper wire 10. After the flattened copper wire has been passed through a welding zone and sent out from a welding machine 14, it is cut to a length of around 35–40 mm with a cutter 21, or taken up suitably and disposed as scrap.

SUMMARY OF THE INVENTION

An object of the present invention is to provide an apparatus for inserting a flattened metal wire into a container, and an apparatus for feeding a flattened metal wire therefrom, the former apparatus being adapted to insert a flattened metal wire, which has been passed through a welding machine, into a cylindrical container so that the metal wire is formed into continuous spiral loops of a constant diameter with the flat surfaces thereof set vertical, the latter apparatus being adapted to feed the flattened metal wire stored in the cylindrical container, while maintaining the metal wire in a predetermined posture when it is put to practical use in a welding machine, without twisting the metal wire.

To achieve this object, the present invention provides an apparatus adapted to wind a flatly-crushed metal wire, around a take-up drum, sequentially determine by action of a traverse the loop-forming positions above a flattened metal wire-storing cylindrical container having inner and outer walls, send the flattened metal wire into the space between the inner and outer walls of the cylindrical container, which is placed vertically on a turntable, while rotating the cylindrical container, and form continuous spiral loops sequentially with the flat surfaces of the flattened metal wire kept vertical, the rotating of the cylindrical container being 360° in the metal wire-inserting direction every time the insertion of one loop portion of the metal wire has been finished, whereby the flattened metal wire can be inserted into the cylindrical container without causing the same to be twisted.

The variations of the diameter D1 of a loop are detected by a position detector, which is disposed above the cylindrical container, for the flattened metal wire, and the rotation of the cylindrical container is controlled so that this diameter becomes substantially $D1=(D2+D3)/2$ (wherein D2 is the inner diameter of the cylindrical container; and D3 the outer diameter of the inner wall thereof), to thereby regulate the diameter of the loop to a predetermined level. According to the present invention, a flattened metal wire is inserted into a cylindrical container as it is formed into continuous spiral loops, in such a manner that the spiral loops are stacked as the centers thereof are shifted at a constant rate in the same direction with the diameters of the loops maintained at a constant level. Hence, the diameters of the first loop to the final loop are identical, and the radii of curvature of these loops are constant. No portions of these loops are twisted and entangled. The loops are thus placed in the cylindrical container with the flat surfaces kept vertical.

In order to withdraw the flattened metal wire from this cylindrical container to put it to practical use, an apparatus similar to the above-mentioned apparatus is used. The flattened metal wire can be sent out from this container without causing the metal wire to be twisted, by determining the position properly from which the flattened metal wire is fed, and controlling the rotation of the cylindrical container so that it is turned at 360° in the metal wire-feeding direction every time the metal wire has been fed from the cylindrical container by a length corresponding to that of one loop.

When the apparatus for inserting and feeding a flattened metal wire into and from a cylindrical container according to the present invention is used as an apparatus for inserting and feeding a flattened copper wire into a cylindrical container in an electric can-welding machine, the rotational speed of an electrode roll and the feed rates of the flattened copper wire and a material to be welded can be set equal with the flattened copper wire, which is fed to the electrode roll, and kept at predetermined speed and tension without causing the wire to be twisted. This copper wire can also be placed from the welding machine into the cylindrical container. This enables the flattened copper wire to be used repeatedly, and a great resource-saving effect can be obtained.

The above and other objects as well as advantageous features of the invention will become apparent from the following description of the preferred embodiments taken in conjunction with the accompanying drawings.

DESCRIPTION OF THE PREFERRED EMBODIMENTS

A preferred embodiment of the present invention, which is used as an apparatus for inserting and feeding a flattened copper wire into and from a cylindrical container in an electric can-welding machine, will now be described in detail with reference to the drawings.

Figure 5A:
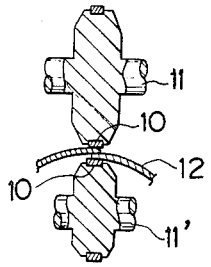
FIG. 5A is a longitudinal section of welding portions of an electrode roll and a flattened metal wire.
Figure 5B:
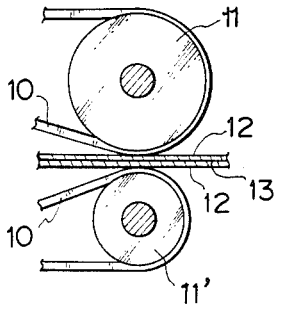
FIG. 5B is a side elevation of the welding portions of FIG. 5A.
Figure 5C:
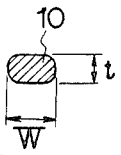
FIG. 5C illustrates the flattened metal wire used in these embodiments.

As shown in FIG. 5C, a flattened metal wire, which is used in the embodiment, is obtained by compressing a copper wire of a 1.38 mm diameter, and has a flattened-circular cross section. It has a thickness t of about 1.0 mm and a width w of about 1.6 mm, and designated by reference numeral 10. In this embodiment, the flattened copper wire is fitted in the grooves in the outer circumferential portion of electrode support rolls 11, 11' as shown in FIG. 5A, and it is turned substantially synchronously with the electrode support rolls 11, 11'. As shown in FIG. 5B, the joint portions of laminated materials to be welded 12 are pressed under a suitable pressure from both sides, thereof by the electrode support rolls 11, 11' through the flattened copper wires 10 to heat welding surface 13 and increase the temperature thereof, and thereby carry out an electric resistance welding operation.

During this welding operation, the whole of the upper and lower outer surfaces of the laminated portions of the materials to be welded 12 are preferably pressed at an equal pressure by the flattened copper wires 10. If either the upper outer surface or the lower outer surface of the laminated portions of the materials to be welded 12 is pressed locally at a high or low pressure due to a twisted part of a flattened copper wire, the electric current flows unevenly to the laminated portions, and the welding cannot be done stably. This would produce an undesirable effect on the quality of a product. Moreover, a dent is left in the outer surface of a flattened copper wire, so that this copper wire cannot be used as an electrode support wire in a subsequent welding operation. Therefore, it is desired that the upper and lower outer surfaces of the laminated portions of the materials to be welded 12 be pressed at an equal pressure by the flat surfaces of the flattened copper wires 10 with the same wires not twisted at all.

Figure 1:
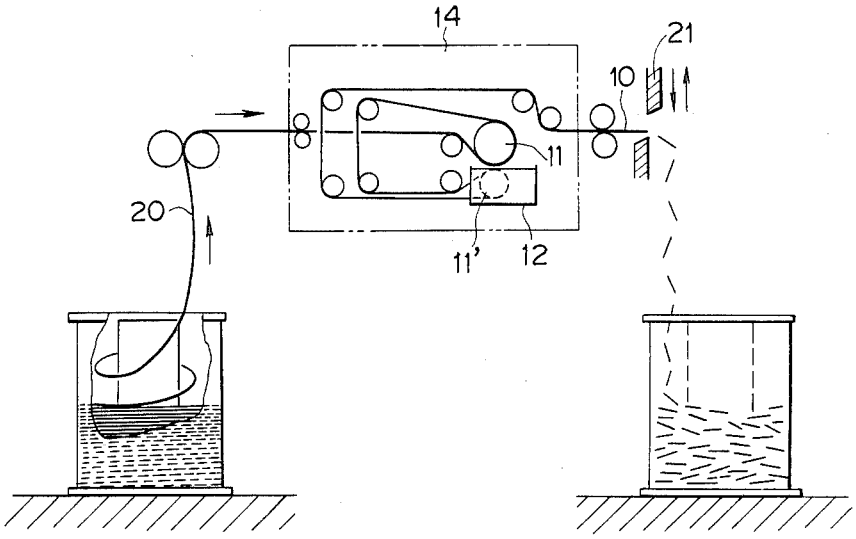
FIG. 1 PRIOR ART
FIG. 1 is a schematic diagram of a prior art apparatus used to subject a thin steel plate to the electric resistance welding.
Figure 2A:
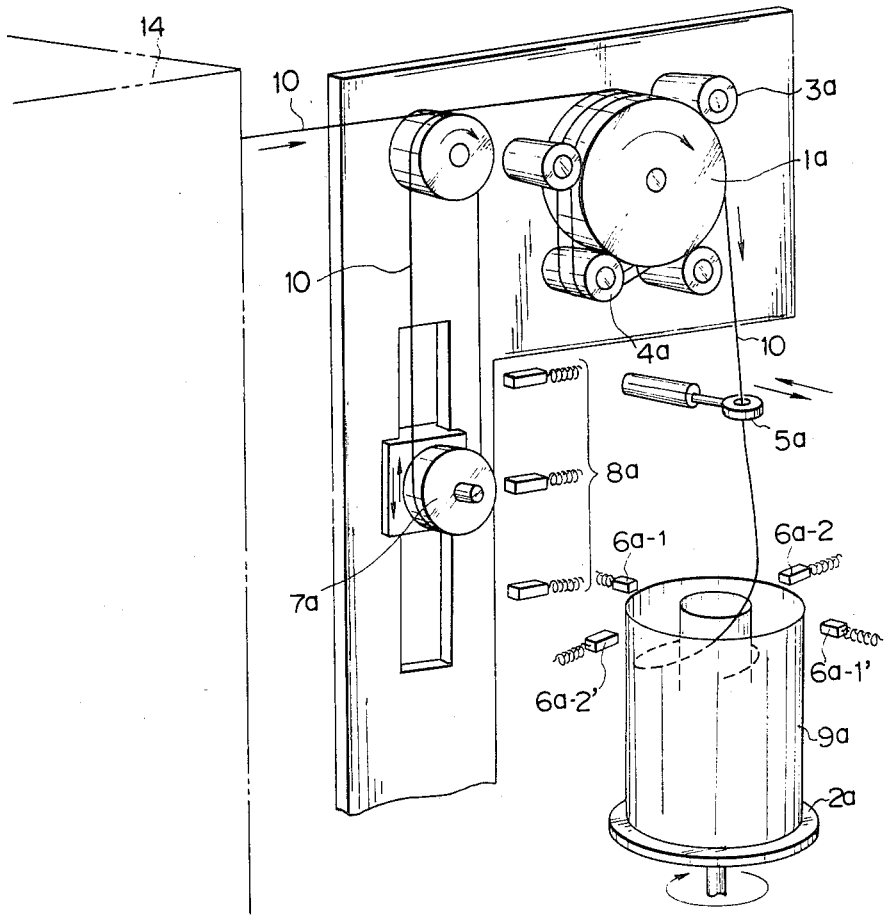
FIG. 2A shows an apparatus for inserting a flattened metal wire into a cylindrical container, that is obtained from the present invention.
Figure 2B:
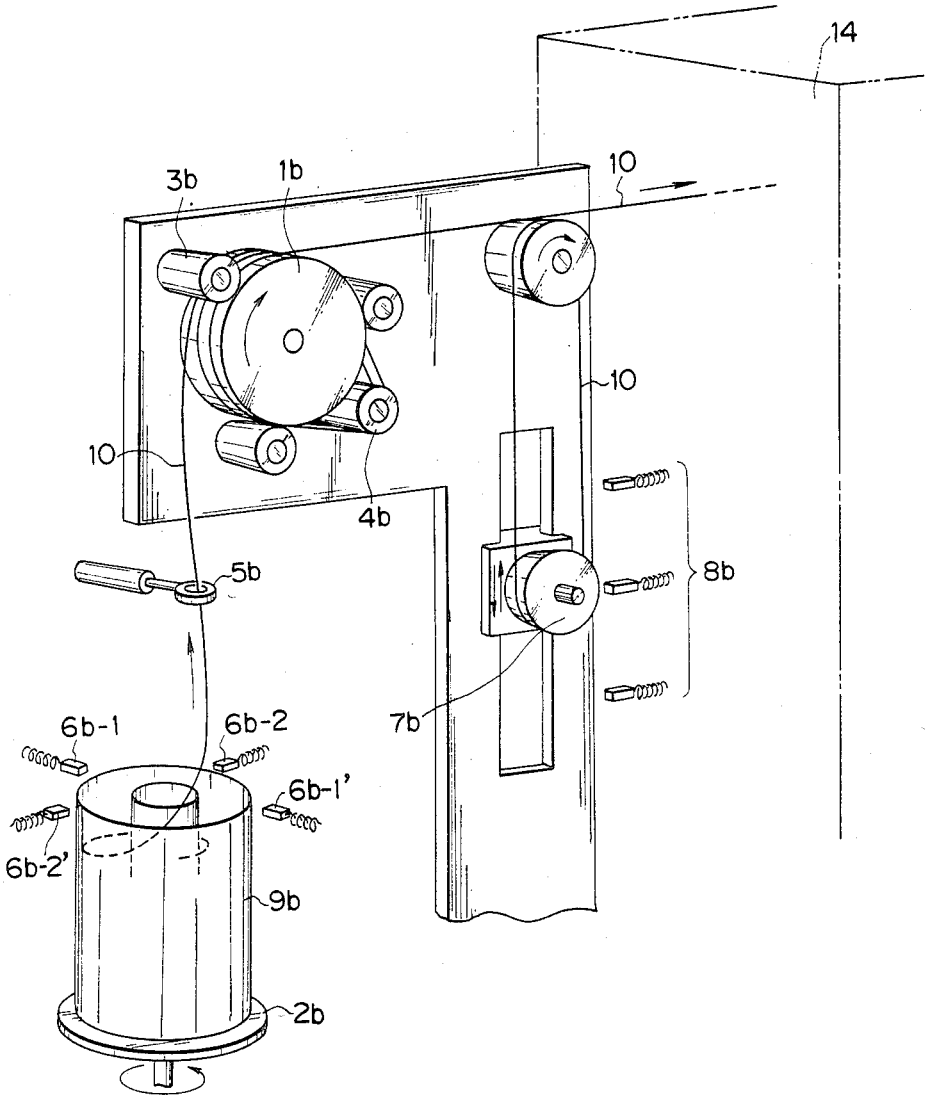
FIG. 2B shows an apparatus for feeding a flattened metal wire from a cylindrical container, that is obtained from the present invention.
Figure 3A:
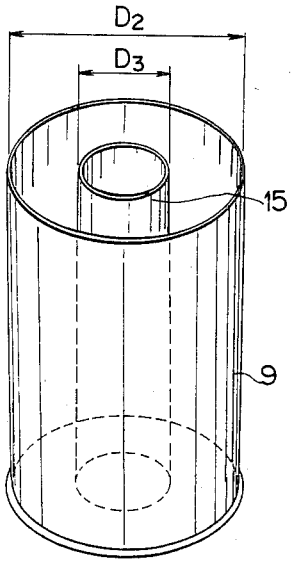
FIG. 3A is a perspective view of a cylindrical container having inner and outer walls, which is used in the embodiments of the present invention.
Figure 3B:
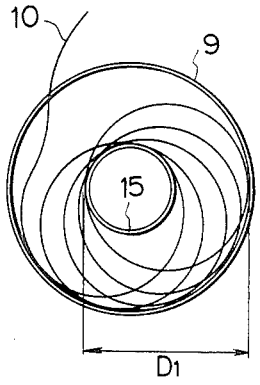
FIG. 3B is a plan view illustrating the insertion of a flattened metal wire into a cylindrical container having inner and outer walls.
Figure 4:
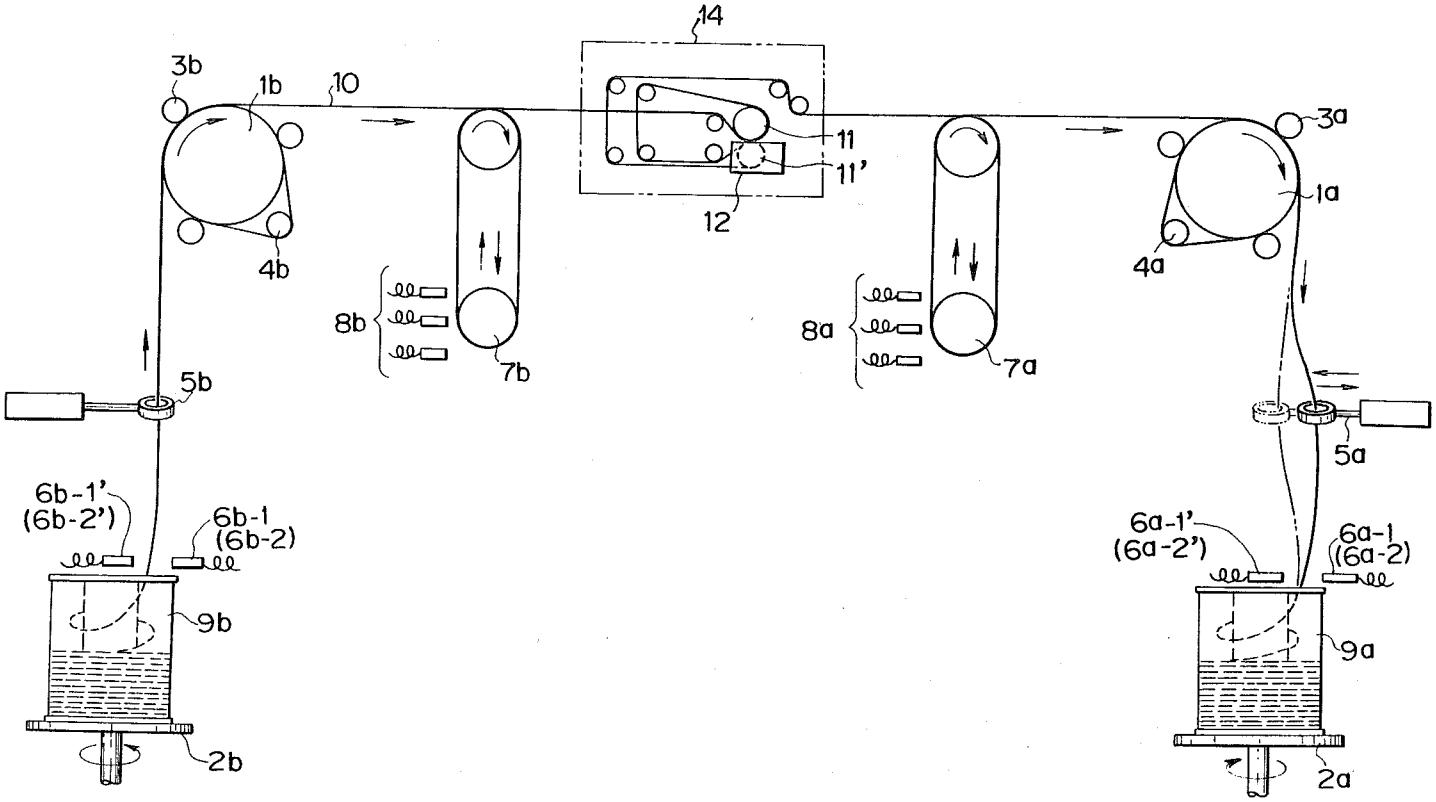
FIG. 4 shows the apparatuses as a whole embodying the present invention, that are used for the electric resistance welding of a thin steel plate.

The flattened copper wire 10 is stored, in the state shown in FIG. 3B in the cylindrical container **9*b*** shown in FIG. 2B and the left lower portion of FIG. 4, in such a manner that the copper wire is wound spirally and continuously in loops the centers of which are staggered from one another with the flat surfaces of the wire and the arcuate opposite end surfaces of each loop kept vertical.

In order to withdraw the flattened copper wire 10 from the cylindrical container **9*b*, a traverse 5*b* disposed above the cylindrical container 9*b* is fixed to guide the copper wire therethrough and move it up in accordance with the spiral loops in the cylindrical container 9*b*. In the lower portion of this embodiment, the cylindrical container 9*b* is set on a turntable 2b so that the cylindrical container 9*b* can be turned in accordance with the rotation of the turntable 2*b*, that is, 360° while one spiral loop of the flattened copper wire is lifted out of the cylindrical container 9*b*. Accordingly, the flattened copper wire can be moved up continuously without being twisted at all. During this time, the position of the portion of the flattened copper wire 10 in upward motion between the upper end of the cylindrical container 9*b* and the traverse 5*b*, which is fixed as a guide, with respect to the outer circumferential surface of the cylindrical container 9*b* is detected by detectors 6*b*-1, 6*b*-1'; 6*b*-2, 6*b*-2' which are provided between the traverse 5*b* and cylindrical container 9*b*, and the rotational speed of the cylindrical container 9*b* is thereby controlled so that the flattened copper wire 10** is not twisted at all while it is moved up.

The flattened copper wire 10 passed through the fixed traverse **5*b* is pressed against a take-up drum 1*b* by three pinch rolls 3*b* and taken up therearound as the copper wire is regulated by the guide roll 4*b* so that a portion of the copper wire is not superposed on another. The copper wire fed from the take-up drum 1*b* is subjected regulation by dancer roll 7*b*** as concerns the length of the copper wire, which occurs owing to the difference between the feed rate of the copper wire in the welding machine and the peripheral speed of the take-up drum.

Namely, when the peripheral speed of the take-up drum 1b is too high, the dancer roll 7 is moved down to store an excess portion of the flattened copper wire, and this is detected by a detector 8b for the movement of the stored portion of the copper wire. The rotational speed of the take-up drum is controlled on the basis of an output from the detector 8b. A constant predetermined tension is thus applied to the copper wire, which is then sent to the electrode support roll 11 without being twisted. The condition of the copper wire 10 in the welding zone is as described in detail previously. The copper wire coming out from the welding zone advances as shown in the right-hand portions of FIGS. 2A and 4.

First, the flattened copper wire is fed without being twisted to a take-up drum 1a by applying a constant predetermined tension to the copper wire with an excess portion thereof stored on a dancer roll 7a. On the take-up drum 1a, the copper wire is pressed thereagainst by three pinch rolls 3a and taken up around the same with the copper wire regulated by one guide roll 4a so that the loops around the drum 1a of the copper wire are not superposed on one another. The copper wire is then sent out at a predetermined speed in the downward direction, and guided to a wire-setting position in a cylindrical container 9a by a traverse 5a, which is adapted to be moved reciprocatingly at a predetermined distance in the horizontal direction.

The flattened copper wire 10 is formed into loops as shown in FIG. 3B, in such a manner that each loop circumscribes the inner wall 15 an inscribes the outer wall of the cylindrical container 9. The cylindrical container 9 in this embodiment has a diameter $D_2$ of the outer wall of about 66 cm, a diameter $D_3$ of the inner wall of about 44 cm and a height of about 87 cm, and is made of hard paper, the diameter $D_1$ of each of the spiral loops of the copper wire being about 55 cm.

The regulation of the diameter of a loop is done as follows.

As shown in FIG. 2A, detectors 6a-1, 6a-1'; 6a-2, 6a-2', each of which consists, for example, of a light-emitting element and a light-receiving element, are arranged in the positions below the traverse 5a and above the cylindrical container 9a in such a manner that the detectors are spaced from each other at a predetermined distance. When the rotational speed of the cylindrical container 9a is higher than the feed rate of the flattened copper wire 10, the diameter of a loop decreases since the position of the portion of the copper wire 10 which is guided to a loop-setting position by the traverse 5a is restricted by the inner wall 15. When the rotational speed of the cylindrical container 9a is lower than the feed rate of the copper wire 10, the diameter of a loop increases. The position from which the copper wire 10 enters the cylindrical container 9a varies in accordance with the variations in the diameter of the loop. This displacement of the copper wire 10 is detected by the detectors, 6a-1, 6a-1'; 6a-2, 6a-2'.

The flattened copper wire can be inserted without being twisted at all into the cylindrical container 9a by controlling the rotational speed of the turntable 2a by which the cylindrical container 9a is turned in accordance with output signals from these detectors.

In this embodiment, the cylindrical containers 9a, 9b, turntables 2a, 2b, traverses 5a, 5b, detectors 6a, 6b and takeup drums 1a, 1b, which are made to the same construction, respectively, can be used in the flattened copper wire inserting apparatus and flattened copper wire feeding apparatus. Accordingly, as shown in FIG. 4, two combinations of these parts can also be provided on the front and rear sides of a welding machine to feed the flattened copper wire 10 from one side, wrap the same copper wire around upper and lower electrode support rolls 11, 11' in the welding zone in the welding machine 14, and insert the copper wire, which has been passed through the welding machine, into the cylindrical container on the other side. In a subsequent operation of these apparatuses, the cylindrical container in which the flattened copper wire is stored is turned by the feed drum in the direction opposite to the direction in which it is turned during the copper wire inserting operation, to send out the copper wire from the upper layer of loops to the welding machine, and then insert the copper wire, which has been passed through the welding machine, into the cylindrical container, which was used for feeding the copper wire in the precedent operation, by rotating this cylindrical container in the reverse direction.

The present invention is not, of course, limited to the above embodiments; it may be modified in various ways within the scope of the appended claims.

What is claimed is:

1. An apparatus for inserting a flattened metal wire into a container, the flattened metal wire being formed into continuous spiral loops the flat surfaces of which are kept vertical, and the spiral loops being stacked in a staggered manner without being twisted, the apparatus comprising a cylindrical container having an inner and outer wall for receiving the flattened metal wire therebetween;

a take-up drum for winding flattened metal wire fed thereto around said take-up drum;

a dancer roll for keeping the feeding rate of the flattened metal wire to said take-up drum constant;

a reciprocating traverse for moving reciprocatingly to determine a position at which the fed flattened metal wire is inserted into said container;

a turntable for rotating said cylindrical container; and detector means for detecting the position of said dancer roll, for controlling synchronously the speed of said turntable, traverse, and take-up drum, for regulating the peripheral speed of said take-up drum to form one spiral loop of the flattened metal wire during one rotation of said turntable, and for regulating the movement of said reciprocating traverse for stacking the spiral loops of metal wire in a staggered manner and with the flat surfaces thereof being kept vertical.

2. An apparatus for feeding a flattened metal wire from a cylindrical container in which the flattened metal wire formed into continuous spiral loops the flat surfaces of which are kept vertical has been stacked in a staggered manner without being twisted, comprising a cylindrical container for holding flattened metal wire formed in loops;

a take-up drum for winding flattened metal wire fed thereto around said take-up drum;

a dancer roll for keeping the feeding rate of flattened metal wire from said take-up drum constant;

a fixed traverse for determining a position from which the flattened metal wire is fed from said cylindrical container;

a turntable for rotating said cylindrical container;

first detector means for detecting the position of said dancer roll, for controlling synchronously the rotation of said turntable and take-up drum, and for regulating the peripheral speed of said take-up drum for winding the flattened metal wire the length of one loop thereof during one rotation of said turntable; and second detector means for detecting the position of the flattened metal wire between said fixed transverse and said cylindrical container and for controlling the rotation of said cylindrical container.

* * * * *